US011214974B2

(12) United States Patent
Smith

(10) Patent No.: US 11,214,974 B2
(45) Date of Patent: Jan. 4, 2022

(54) HOT TUB VACUUM ATTACHMENT APPARATUS

(71) Applicant: Ryan Smith, Wasilla, AK (US)

(72) Inventor: Ryan Smith, Wasilla, AK (US)

( * ) Notice: Subject to any disclaimer, the term of this patent is extended or adjusted under 35 U.S.C. 154(b) by 86 days.

(21) Appl. No.: 16/787,895

(22) Filed: Feb. 11, 2020

(65) Prior Publication Data

US 2021/0246678 A1 Aug. 12, 2021

(51) Int. Cl.
*E04H 4/16* (2006.01)

(52) U.S. Cl.
CPC ..... *E04H 4/1645* (2013.01)

(58) Field of Classification Search
CPC ..... E04H 4/1645
See application file for complete search history.

(56) References Cited

U.S. PATENT DOCUMENTS 4,962,559 A 10/1990 Schuman
5,317,776 A 1/1994 DeMoura
5,311,631 A * 5/1994 Smith, Jr. ..... E04H 4/1645 15/1.7
6,248,232 B1 6/2001 Stoner
6,942,790 B1 9/2005 Dolton
7,090,769 B1 8/2006 Peterson
7,805,793 B2 10/2010 Paxton
9,453,355 B1 * 9/2016 Rasp ..... E04H 4/1645
2015/0166368 A1 * 6/2015 Braunberger ..... E04H 4/1663 210/167.12

FOREIGN PATENT DOCUMENTS

WO WO2007074335 7/2007

* cited by examiner

*Primary Examiner* — Randall E Chin

(57) ABSTRACT

A hot tub vacuum attachment apparatus for cleaning debris from a hot tub utilizing the integrated pump system includes an attachment head to selectively engage a filter housing of a hot tub or pool. A tubular stem has a stem outlet end coupled to, and in fluid communication with, the attachment head. A filter mount is coupled to the tubular stem. The filter mount has an output end coupled to a stem inlet end of the tubular stem, an input end, and a filter receiver coupled between the output end and the input end. A filter system is coupled the filter receiver of the filter mount. All fluid flowing from the input end to the output end passes through the filter system to collect particles and debris. A flexible hose has a hose proximal end coupled to the input end of the filter mount and a hose distal end.

11 Claims, 4 Drawing Sheets

HOT TUB VACUUM ATTACHMENT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hot tub cleaning devices and more particularly pertains to a new hot tub cleaning device for cleaning debris from a hot tub utilizing the integrated pump system.

(2) Description of Related Art Including Information Disclosed Under 37 CFR 1.97 and 1.98

The prior art relates to hot tub cleaning devices for removing debris without draining. Existing devices typically require their own suction generation device or require a designated attachment specifically for vacuums. Such devices cannot attach to a generic filter housing to create a suction source directly from the hot tub.

BRIEF SUMMARY OF THE INVENTION

An embodiment of the disclosure meets the needs presented above by generally comprising an attachment head configured to selectively engage a filter housing of a hot tub or pool. A tubular stem has a stem outlet end coupled to, and in fluid communication with, the attachment head. A filter mount is coupled to the tubular stem. The filter mount has an output end coupled to a stem inlet end of the tubular stem, an input end, and a filter receiver coupled between the output end and the input end. A filter system is coupled the filter receiver of the filter mount. All fluid flowing from the input end to the output end passes through the filter system to collect particles and debris. A flexible hose has a hose proximal end coupled to the input end of the filter mount and a hose distal end.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
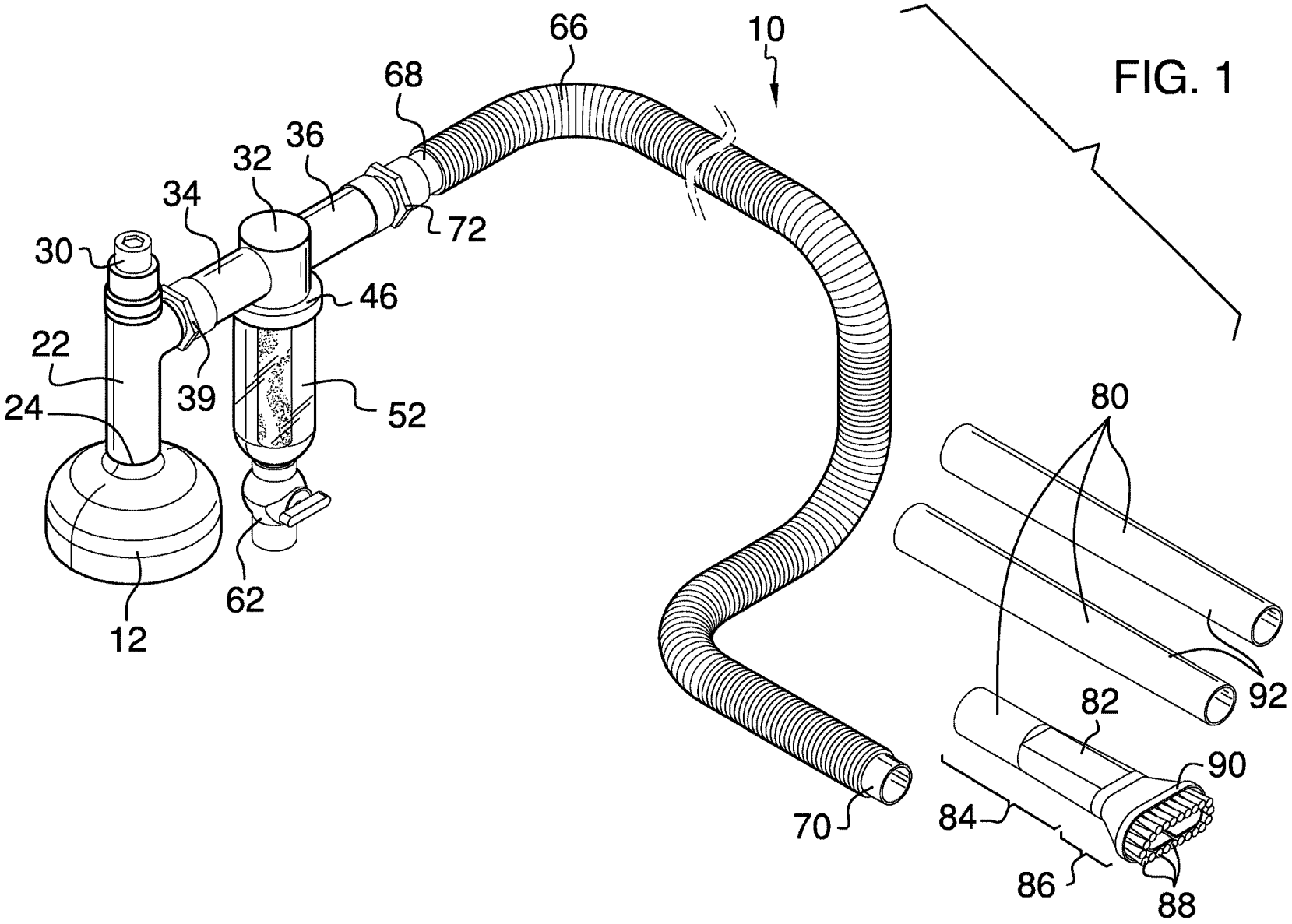
FIG. 1 is an isometric view of a hot tub vacuum attachment apparatus according to an embodiment of the disclosure.
Figure 2:
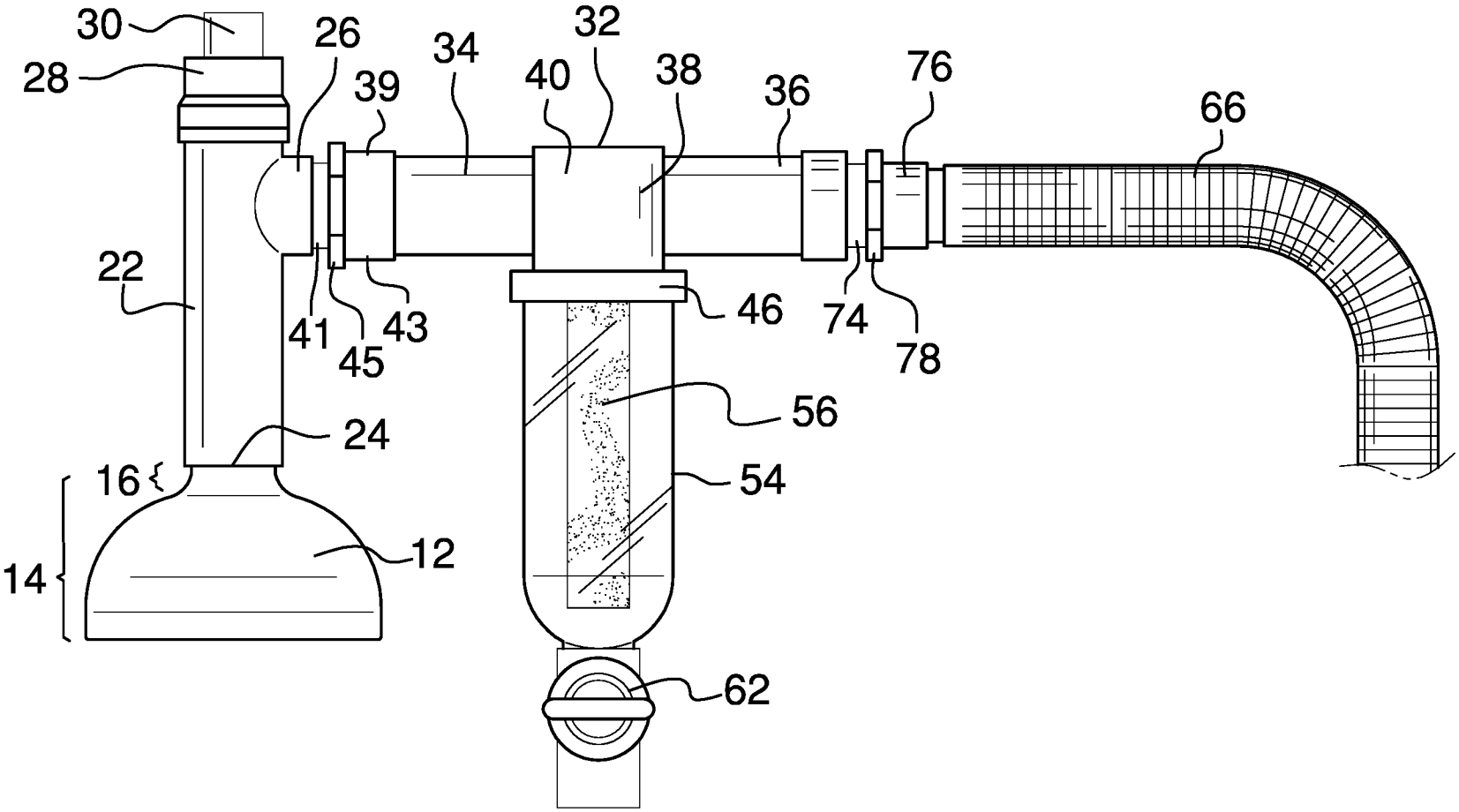
FIG. 2 is a side elevation view of an embodiment of the disclosure.
Figure 3:
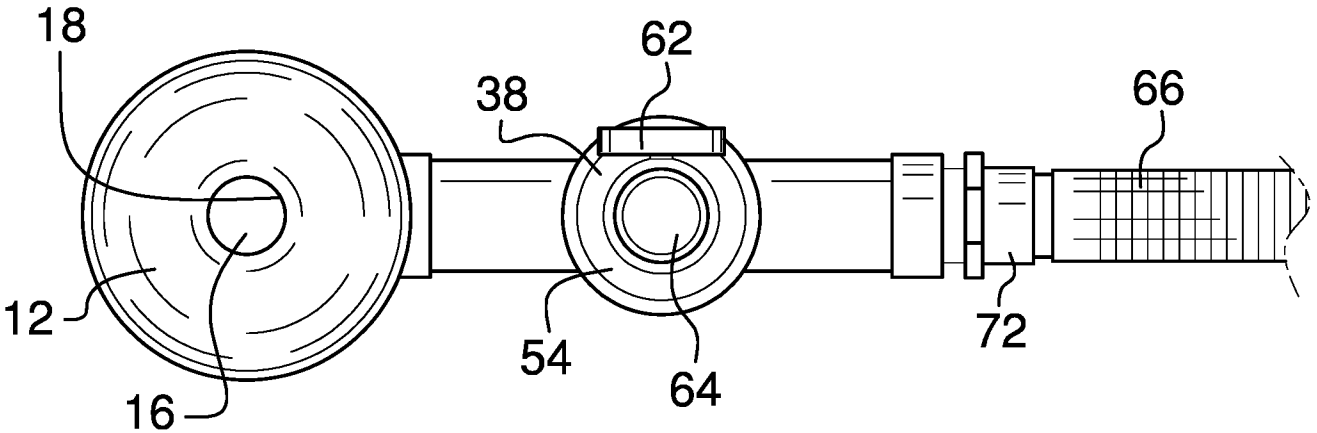
FIG. 3 is a bottom plan view of an embodiment of the disclosure.
Figure 4:
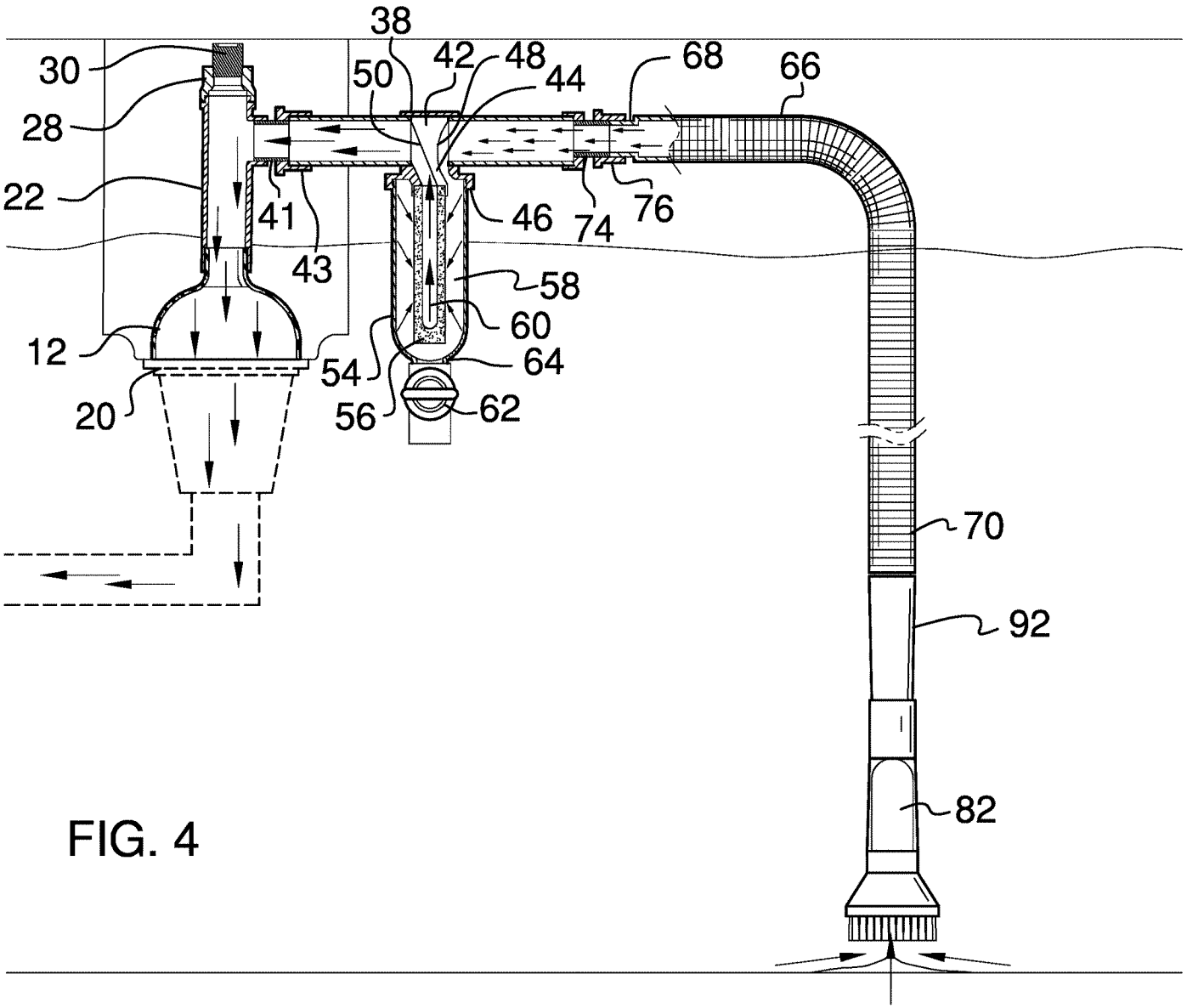
FIG. 4 is a cross-sectional in-use view of an embodiment of the disclosure.

With reference now to the drawings, and in particular to FIGS. 1 through 4 thereof, a new hot tub cleaning device embodying the principles and concepts of an embodiment of the disclosure and generally designated by the reference numeral 10 will be described.

As best illustrated in FIGS. 1 through 4, the hot tub vacuum attachment apparatus 10 generally comprises an attachment head 12. The attachment head 12 may include an inverted cup-shaped cup portion 14 having a central cup aperture 16 extending therethrough and a neck portion 18 extending up from the cup portion 14 around the cup aperture 16. The attachment head 12 is configured to selectively engage a filter housing 20 of a hot tub or pool. The attachment head 12 may be rubberized and sufficiently deformable to sealingly engage the filter housing 20 and be secured by suction created by the hot tub or pool pump.

A tubular stem 22 is coupled to the attachment head 12. The tubular stem 22 has a stem outlet end 24 coupled to the neck portion 18 of the attachment head. The tubular stem 22 may be T-shaped and has a stem inlet end 26 extending perpendicularly from the stem outlet end 24 and a stem capped end 28 opposite the stem outlet end 24. The stem capped end 28 may include a selectively removable stem cap 30 to provide access within the tubular stem 22 to easily clear blockages. The tubular stem 22 is shaped and dimensioned to direct the apparatus 10 towards the hot tub or pool and to provide appropriate clearance for the apparatus 10 to not interfere with the hot tub or pool during use.

A filter mount 32 is coupled to the tubular stem 22. The filter mount 32 has an output end 34 coupled to the stem inlet end 26 of the tubular stem, an input end 36, and a filter receiver 38 coupled between the output end 34 and the input end 36. A first coupler 39 may include a first male threaded portion 41 engaged within the stem inlet end 26 and a first female threaded portion 43 engaged with the output end 34. The first female threaded portion 43 may have a first faceted collar 45 configured to receive a wrench. The filter receiver 38 may be cylindrical with the output end 34 and the input end 36 being tubular and extending from a receiver sidewall 40 of the filter receiver. The filter receiver 38 may have an internal diverter 42, a filter mouth 44, and a canister mount 46. The internal diverter 42 may have a curved side 48 facing the input end 36 to direct flow and a planar side 50 partially defining the filter mouth 44. The filter mouth 44 is in fluid communication with the output end 34.

A filter system 52 is coupled to filter receiver 38. The filter system 52 may comprise a filter canister 54 selectively engaged with the canister mount 46 and an inner fitter 56 selectively engaged with the filter mouth 44. The filter canister 54 and the inner filter 56 define a pre-filtration chamber 58 and a post-filtration chamber 60. The internal diverter 42 directs flow from the input end 36 into the pre-filtration chamber 58, through the inner fitter 56 to the post-filtration chamber 60, and out the filter mouth 44 to pass to the output end 34. All fluid flowing from the input end 36 to the output end 34 thus passes through the filter system 52 to collect particles and debris. The filter system 52 may further comprise a release valve 62 coupled to a release aperture 64 extending through the filter canister 54. The filter canister 54 may thus be drained after use before it is disengaged from the canister mount 46 to remove the particles and debris.

A flexible hose 66 has a hose proximal end 68 coupled to the input end 36 of the filter mount and a hose distal end 70. A second coupler 72 may include a second male threaded portion 74 engaged within the input end 36 and a second female threaded portion 76 to selectively receive the hose proximal end 68. The second female threaded portion 76 may have a second faceted collar 78 configured to receive a wrench. Each of a plurality of hose attachments 80 is selectively engageable with the hose distal end 70. The plurality of hose attachments 80 may include at least one brush head 82 having a tubular brush neck portion 84, an angled brush head portion 86, and a plurality of bristles 88 coupled to a perimeter 90 of the brush head portion. The plurality of hose attachments 80 may also include at least one tubular extension handle 92 to be coupled between the hose distal end 70 to increase the reach of the apparatus 10. The brush head 82 is selectively engageable with the tubular extension handle 92.

In use, the attachment head 12 is engaged with the filter housing 20. The hot tub or pool pump is then activated to create suction through the apparatus. The desired hose attachment 80 is engaged with the hose distal end 70 and the hot tub or pool is cleaned. When complete, the release valve 62 is opened to drain the filter canister 54 and the filter canister 54 is disengaged from the canister mount 46 to remove the particles and debris.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hot tub vacuum attachment apparatus comprising:

an attachment head, the attachment head being configured to selectively engage a filter housing of a hot tub or pool;

a tubular stem coupled to the attachment head, the tubular stem having a stem outlet end coupled to, and in fluid communication with, the attachment head;

a filter mount coupled to the tubular stem, the filter mount having an output end coupled to a stem inlet end of the tubular stem, an input end, and a filter receiver coupled between the output end and the input end;

a filter system coupled to the filter mount, the filter system being coupled to the filter receiver, all fluid flowing from the input end to the output end passing through the filter system to collect particles and debris; and a flexible hose coupled to the filter mount, the hose having a hose proximal end coupled to the input end of the filter mount and a hose distal end.

2. The hot tub vacuum attachment apparatus of claim 1 further comprising a plurality of hose attachments, each hose attachment being selectively engageable with the hose distal end.

3. The hot tub vacuum attachment apparatus of claim 2 further comprising the plurality of hose attachments including at least one brush head having a tubular brush neck portion, an angled brush head portion, and a plurality of bristles coupled to a perimeter of the brush head portion.

4. The hot tub vacuum attachment apparatus of claim 1 further comprising the attachment head being an inverted cup shape and having a central cup aperture extending therethrough.

5. The hot tub vacuum attachment apparatus of claim 4 further comprising the attachment head having a cup portion and a neck portion extending up from the cup portion around the cup aperture, the neck portion being selectively engageable within the stem outlet end.

6. The hot tub vacuum attachment apparatus of claim 1 further comprising the tubular stem being T-shaped with the stem inlet end extending perpendicularly from the stem outlet end and a stem capped end opposite the stem outlet end.

7. The hot tub vacuum attachment apparatus of claim 6 further comprising the stem capped end including a selectively removable stem cap to provide access within the tubular stem.

8. The hot tub vacuum attachment apparatus of claim 1 further comprising the filter receiver being cylindrical, the output end and the input end being tubular and extending from a receiver sidewall of the filter receiver, the filter receiver having an internal diverter, a filter mouth, and a canister mount, the filter mouth being in fluid communication with the output end.

9. The hot tub vacuum attachment apparatus of claim 8 further comprising the filter system comprising a filter canister selectively engaged with the canister mount and an inner filter selectively engaged with the filter mouth, the internal diverter directing flow from the input end into the filter canister, through the inner filter, and out the filter mouth to pass to the output end.

10. The hot tub vacuum attachment apparatus of claim 9 further comprising the filter system further comprising a release valve coupled to a release aperture extending through the filter canister.

11. A hot tub vacuum attachment apparatus comprising:

an attachment head, the attachment head including an inverted cup-shaped cup portion having a central cup aperture extending therethrough and a neck portion extending up from the cup portion around the cup aperture, the attachment head being configured to selectively engage a filter housing of a hot tub or pool;

a tubular stem coupled to the attachment head, the tubular stem having a stem outlet end coupled to the neck portion of the attachment head, the tubular stem being T-shaped and having a stem inlet end extending perpendicularly from the stem outlet end and a stem capped end opposite the stem outlet end, the stem capped end including a selectively removable stem cap to provide access within the tubular stem;

a filter mount coupled to the tubular stem, the filter mount having an output end coupled to the stem inlet end of the tubular stem, an input end, and a filter receiver coupled between the output end and the input end, the filter receiver being cylindrical, the output end and the input end being tubular and extending from a receiver sidewall of the filter receiver, the filter receiver having an internal diverter, a filter mouth, and a canister mount, the filter mouth being in fluid communication with the output end;

a filter system coupled to the filter mount, the filter system being coupled to the filter receiver, the filter system comprising a filter canister selectively engaged with the canister mount and an inner filter selectively engaged with the filter mouth, the internal diverter directing flow from the input end into the filter canister, through the inner filter, and out the filter mouth to pass to the output end, all fluid flowing from the input end to the output end passing through the filter system to collect particles and debris, the filter system further comprising a release valve coupled to a release aperture extending through the filter canister;

a flexible hose coupled to the filter mount, the hose having a hose proximal end coupled to the input end of the filter mount and a hose distal end; and a plurality of hose attachments, each hose attachment being selectively engageable with the hose distal end, the plurality of hose attachments including at least one brush head having a tubular brush neck portion, an angled brush head portion, and a plurality of bristles coupled to a perimeter of the brush head portion.

* * * * *